US006615449B1

(12) United States Patent
Alvarez

(10) Patent No.: US 6,615,449 B1
(45) Date of Patent: Sep. 9, 2003

(54) RELEASABLE LOCKING ASSEMBLY FOR A DOOR CONTROL CYLINDER

(76) Inventor: Arthur Alvarez, W 180 County Rd. DD, Birchwood, WI (US) 54817

( * ) Notice: Subject to any disclaimer, the term of this patent is extended or adjusted under 35 U.S.C. 154(b) by 0 days.

(21) Appl. No.: 10/120,868

(22) Filed: Apr. 12, 2002

Related U.S. Application Data

(60) Provisional application No. 60/354,690, filed on Feb. 6, 2002.

(51) Int. Cl.[7] ..... E05F 3/00

(52) U.S. Cl. ..... 16/66; 16/70; 16/65; 16/80

(58) Field of Search ..... 16/66, 70, 65, 16/78, 80, 72

(56) References Cited

U.S. PATENT DOCUMENTS

| | | | | | |
|---|---|---|---|---|---|
| 2,843,226 | A | * | 7/1958 | Nordmark | 188/67 |
| 3,105,264 | A | * | 10/1963 | Truhon | 16/66 |
| 3,162,889 | A | * | 12/1964 | Runnels | 16/66 |
| 4,194,264 | A | * | 3/1980 | Stoffregen | 16/52 |
| 4,286,412 | A | | 9/1981 | Stevens | |
| 4,382,311 | A | | 5/1983 | Watts | |
| 4,545,322 | A | | 10/1985 | Yang | |
| 4,707,882 | A | | 11/1987 | Watts | |
| 4,722,116 | A | * | 2/1988 | Erickson | 16/49 |
| 4,815,163 | A | | 3/1989 | Simmons | |
| 4,920,609 | A | | 5/1990 | Lin | |
| 5,048,150 | A | | 9/1991 | Guerin | |
| 5,529,148 | A | | 6/1996 | O'Leary | |
| 5,592,780 | A | | 1/1997 | Checkovich | |
| 5,630,248 | A | * | 5/1997 | Luca | 16/71 |
| 5,659,925 | A | | 8/1997 | Patterson | |
| 5,829,097 | A | * | 11/1998 | Toledo | 16/53 |
| 5,832,562 | A | | 11/1998 | Luca | |
| 5,842,255 | A | | 12/1998 | Luca | |
| 6,202,253 | B1 | | 3/2001 | Green | |
| 6,317,922 | B1 | | 11/2001 | Kondratuk | |

* cited by examiner

*Primary Examiner*—J. J. Swann
*Assistant Examiner*—Matthew E. Rodgers
(74) *Attorney, Agent, or Firm*—Tipton L. Randall

(57) ABSTRACT

A releasable locking assembly for a door control cylinder is disclosed. The assembly fits over the rod of the door control cylinder and includes a locking flange member maintained in a confined space within a pair of concentric closed end cup members. The locking flange member engages the rod to hold the door control cylinder in an extended position by gently pushing on the outer cup member and disengages the locking flange member by further opening the door, allowing the cylinder rod to retract in a controlled manner.

20 Claims, 6 Drawing Sheets

RELEASABLE LOCKING ASSEMBLY FOR A DOOR CONTROL CYLINDER

CROSS-REFERENCE TO RELATED APPLICATIONS, IF ANY

This application claims the benefit under 35 U.S.C. §119 (e) of provisional application Ser. No. 60/354,690, filed Feb. 6, 2002. Application Ser. No. 60/354,690 is hereby incorporated by reference.

STATEMENT REGARDING FEDERALLY SPONSORED RESEARCH OR DEVELOPMENT

Not applicable

REFERENCE TO A MICROFICHE APPENDIX, IF ANY

Not applicable.

BACKGROUND OF THE INVENTION

1. Field of the Invention

The present invention relates, generally, to door hardware. More particularly, the invention relates to a door control cylinder. Most particularly, the invention relates to a releasable locking assembly for a door control cylinder.

2. Background Information

The state of the art includes various locking mechanisms for door control cylinders. This technology is believed to have significant limitations and shortcomings, including but not limited to that the mechanisms are difficult to operate, marginally effective and costly to manufacture.

Some examples of inventions concerning locking mechanisms for door control cylinders and the like for which patents have been granted include the following.

Stevens, in U.S. Pat. No. 4,286,325, describes a hold-open device for use with a conventional door closer. There is a shoe moving along a track and connected to the closer operating arm. A latch holds the shoe with the door open. The latch is attached to a frame near the track and may be moved away from latching engagement with the shoe by either forcibly closing the door or by deactivating the closer.

In U.S. Pat. No. 4,382,311, Watts discloses a pneumatic door-closer that includes a cylinder with a rod that extends upon opening the door. The rod has a series of transverse grooves and a clip encircling the rod. The clip has opposed ribs that can engage the grooves when the clip is rotated in one direction and disengage the grooves when the clip is rotated in the opposite direction to lock and unlock the clip on the rod.

Yang, in U.S. Pat. No. 4,545,322, describes a constant drag device the includes a cylinder with a stretchable tube-like sleeve surrounding and gripping an inner rod or tube. A coil spring surrounds the sleeve in position to resist movement on one end of the sleeve against the spring force. Moving the rod axially relative to the spring in a direction against the spring force on 5 the sleeve decreases the inner diameter of the sleeve to produce a drag on the inner member.

In U.S. Pat. No. 4,707,882, Watts discloses a pneumatic door-closer that includes a cylinder with a rod that extends upon opening the door. The rod has a series of transverse grooves and a clip encircling the rod. The clip has opposed ribs that can engage the grooves when the clip is rotated in one direction and disengage the grooves when the clip is rotated in the opposite direction to lock and unlock the clip on the rod.

Simmons, in U.S. Pat. No. 4,815,163, discloses a storm door locking apparatus that includes a clamp secured to the door cylinder with a slidable rod mounted thereto which is attached to a locking flange for engaging the cylinder rod to hold the door open. The user locks the door open by pushing a lever at the opposite end of the slidable rod.

In U.S. Pat. No. 4,920,609, Lin describes a pneumatic door closer that includes an actuator encircling the plunger rod and mounted in a plug. The actuator is biased by a spring and engages an annular groove in the plunger rod to hold the door open. The actuator is disengaged by opening the door further which causes a sleeve to disengage the actuator from the annular groove.

Guerin, in U.S. Pat. No. 5,048,150, describes a door holder that includes a piston unit with a separate rod attached by a housing to the piston unit and the door jamb. The rod has a cantable washer that is actuated by a pneumatic unit positioned on the floor for actuation by a user's foot.

In U.S. Pat. No. 5,529,148, O'Leary discloses an automatic brake and holding mechanism for sliding rods to maintain the rod at any desired position of extension or retraction with respect to an associated housing. A brake surrounds a rod with the brake confined within a barrel having a slot for holding the brake tab with the brake biased by a spring surrounding the rod. A release sleeve encircles the rod and has an enlarged end that can contact the brake. Also present is a latch that mounts to the exterior of the barrel, with a brake trip extending into the barrel through a slot therein.

Checkovich, in U.S. Pat. No. 5,592,780, describes a door position controlling apparatus. The apparatus includes a piston rod with a latch plate that is suspended by a flexing means to lock onto the rod and hold the door open. There is an electronic unit that imparts a force on a magnetized shaft to unlock the latch plate from the rod and allow the cylinder rod to retract and close the attached door.

In U.S. Pat. No. 5,630,248, Luca discloses a door closer with semi-automatic latching. The cylinder rod has a cantable washer confined to a short longitudinal space in the cylinder and riding on the rod. The washer is maintained in an essentially perpendicular orientation on the rod and a positional support is movable into the washer space to cant the washer, arrest the cylinder rod and hold the door open. To unlatch the door, the positionable support is withdrawn to avoid canting contact with the washer. The positional support may be a pin or a tab, with the washer having cut out portions.

Patterson, in U.S. Pat. No. 5,659,925, describes a door closer holding mechanism that includes a slidable stop on another rod that rides on the exterior of a cylinder with the stop dropping between the cylinder and door jamb to hold the door open. The stop has a lever for disengaging the device from between the cylinder and the door jamb.

U.S. Pat. No. 5,832,562 by Luca describes another door closer that includes a cylinder rod with a cantable washer confined to a short longitudinal space in the cylinder and riding on the rod. The washer is spring biased, and there is a complex arming and latching mechanism that includes a lever, a head, a spring and a trigger. The arming and latching of the mechanism is shown in FIGS. 4A–4G. Several other embodiments of the arming and latching mechanism, one with a slidable button as shown in FIGS. 5A–5E, and a toggle button as shown in FIGS. 6A–6E, are also disclosed.

In U.S. Pat. No. 5,842,255, Luca discloses another door closer that includes a cylinder rod with a complex tapered latching means confined to a short longitudinal space in the cylinder and riding on the rod. In one embodiment, a cantable washer interacts with a sliding eccentric support to lock the washer on the rod.

Green, in U.S. Pat. No. 6,202,253, describes a storm door cylinder lock that automatically locks the cylinder in an open position when the door is opened past 90 degrees. The cylinder includes an arm assembly, a cylindrical catch piece and a hard stop.

U.S. Pat. No. 6,317,922 by Kondratuk describes another door closer that includes a cylinder rod with a cantable washer having an angled portion, the washer confined to a short longitudinal space in the cylinder and riding on the rod. There is a base portion that forms the end of the cylinder and a cap that attaches to the base and encloses the washer. The base has a stepped surface that faces the cap, and the cap has positioning pegs to hold the washer in place. Rotating the cap in one direction causes the washer to engage the rod due to the stepped surface of the base, and rotating the cap in the opposite direction disengages the washer.

For this and other reasons, a need exists for the present invention. This invention provides a releasable locking assembly which is believed to fulfill the need and to constitute an improvement over the background technology.

All United States patents and patent applications, and all other published documents mentioned anywhere in this application are incorporated by reference in their entirety.

BRIEF SUMMARY OF THE INVENTION

The present invention provides a releasable locking assembly apparatus/method for door control cylinders. Advantages and significant features of the invention include, but are not necessarily limited to, a releasable locking assembly that is simple to operate and install on existing door control cylinders. Further, the assembly of the present invention is uncomplicated and economical to manufacture.

The releasable locking assembly for selectively locking and unlocking a door control cylinder, having a spring biased rod member extending from an end thereof, includes a movable locking member encircling the cylinder rod member and retained within a first confining member secured to an end of the control cylinder with the rod member extending through the first confining member. The movable locking member is biased against an interior end of the first confining member opposite the control cylinder. A biased, linear actuating member parallels the rod member and traverses the first confining member end opposite the cylinder. The actuating member is movable to cant the locking member upon the rod member to secure the rod member in an extended condition. A second confining member is moveably secured to the first confining member and operatively connected to the biased, linear actuation member. Moving the second confining member toward the first confining member causes the biased actuation member to cant the locking member on the rod member to lock the rod member in an extended condition from the control cylinder. The locking member releases the rod member upon further extending the rod member from the control cylinder.

In a further embodiment of the invention, a releasable locking assembly for selectively locking and unlocking a door control cylinder, having a spring biased rod member extending from an end thereof, includes a movable locking member encircling the cylinder rod member and retained within a first cup member, having an open end and a closed end. The cup open end is secured to an end of the control cylinder with the rod member extending axially through the first cup member. The first cup member has a spacer member therein for maintaining a confined space between the first cup member closed end and the control cylinder end for the movable locking member. The movable locking member is biased against an interior closed end of the first cup member opposite the control cylinder by a first rod-encircling spring member. A biased, linear actuating member parallels the rod member and traverses the first cup member end opposite the cylinder. The actuating member is free moving and retained within an offset aperture in the first cup member closed end opposite the control cylinder, with a biasing spring surrounding the actuation member exterior the first cup member. The actuating member moves to cant the locking member upon the rod member to secure the rod member in an extended condition. A second cup member has an open end and a closed end with a axial aperture therein. The second cup member open end is moveably secured about the first cup member and operatively connected to the biased, linear actuation member. Moving the second cup member toward the first cup member causes the biased actuation member to cant the locking member on the rod member to lock the rod member in an extended condition from the control cylinder. The locking member releases the rod member upon further extending the rod member from the control cylinder.

The features, benefits and objects of this invention will become clear to those skilled in the art by reference to the following description, claims, and seven drawings.

DETAILED DESCRIPTION OF THE EMBODIMENTS

Nomenclature

10 Releasable Locking Assembly
15 First Biasing Spring
20 Locking Flange Member
25 Positioning Tab
30 Locking Tab
35 First Cylindrical Cup Member
40 Closed End of First Cup Member

45 Central Aperture of First Cup Member Closed End
50 Positioning Tab Slot
55 Offset Aperture of First Cup Member Closed End
60 Second Biasing Spring Member
65 Second Cylindrical Cup Member
70 Closed End of Second Cup Member
75 Central Aperture of Second Cup Member Closed End
80 Retaining Rim Portion of Second Cup Member
85 Release Tab Actuating Member
90 Spacer Member
95 Peg Member
C Door Control Cylinder
F1 First Fastener
R Cylinder Rod
F2 Rod Fastener End

Construction

It is common practice to employ door control cylinders, particularly for storm doors. The control device consists of a cylinder C having a rod R that moveably extends from one end of the cylinder C. The end of the cylinder opposite the rod R contains a fastener F1 that is secured to the door jamb, while the rod R has a fastener end F2 that is secured approximately at the center line of the door. As the door opens, the rod R extends from the cylinder C and prevents the door from swinging open too far. Additionally, the cylinder C provides for a slow return of the rod R into the cylinder C when the door is released, thereby preventing the storm door from slamming. Various releasable locking mechanisms have been developed to lock the cylinder rod R in an extended condition to hold the storm door open. The mechanism is unlocked to allow the door to close on its own. The present invention is an improved releasable locking assembly for such a door control cylinder device.

Figure 1:
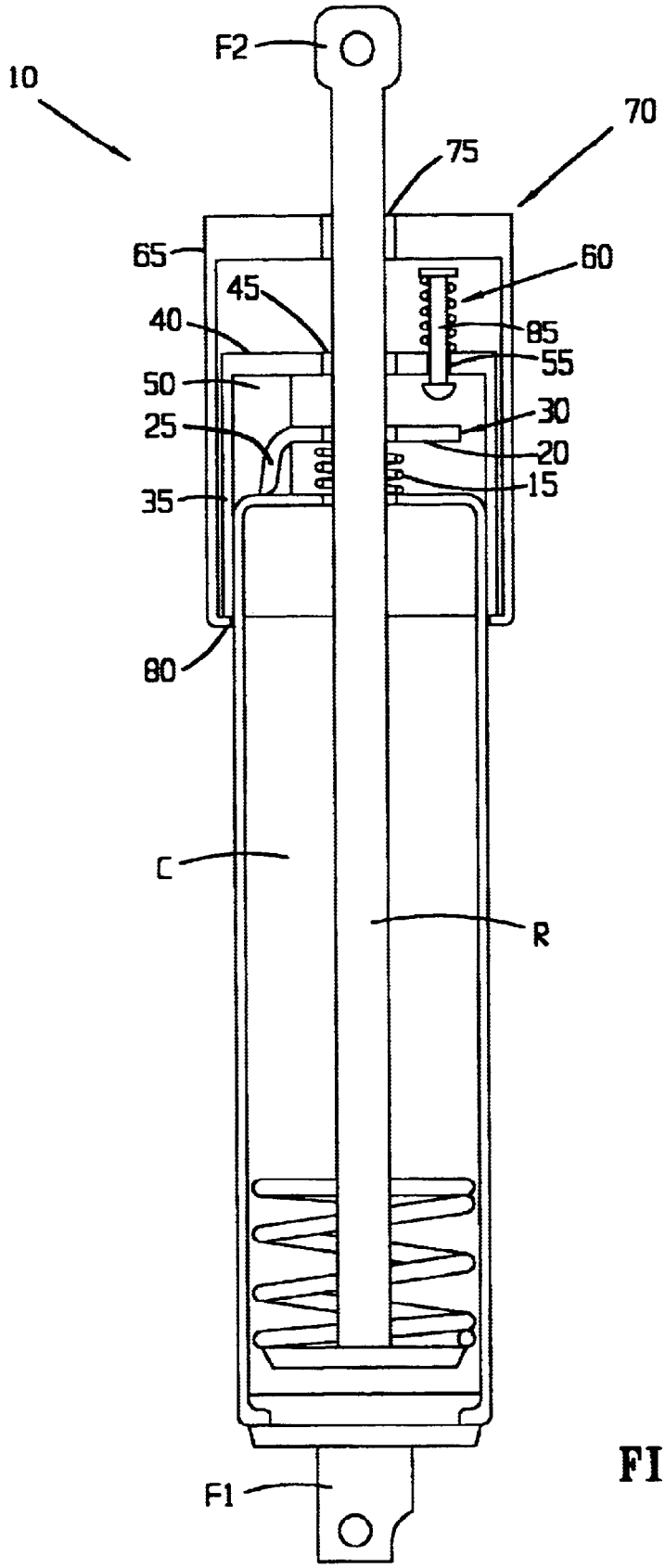
FIG. 1 is a cross sectional view of one embodiment of the releasable locking assembly of the present invention installed on a door control cylinder.

Referring now to FIGS. 1–8, several embodiments of the releasable locking assembly 10 are shown. The assembly 10 is designed to be installed on a door control cylinder C and provide facile locking and unlocking of the cylinder rod R at any extended position. Referring to FIG. 1, the assembly 10 includes a first biasing spring member 15 that encircles the rod R adjacent the point where the rod R extends from the control cylinder C. A planar locking flange member 20, having a central aperture, fits onto the rod R beyond the spring member 15. The flange member 20 has a central aperture larger than the rod diameter to allow the flange member 20 to turn slightly from perpendicular and lock on the rod R. The flange member 20 has a positioning tab 25 set at a right angle to the planar flange member 20 and a locking tab 30 opposite the positioning tab 25. The positioning tab 25 is oriented toward the control cylinder C, when the flange member 20 is installed on the rod R.

Figure 2:
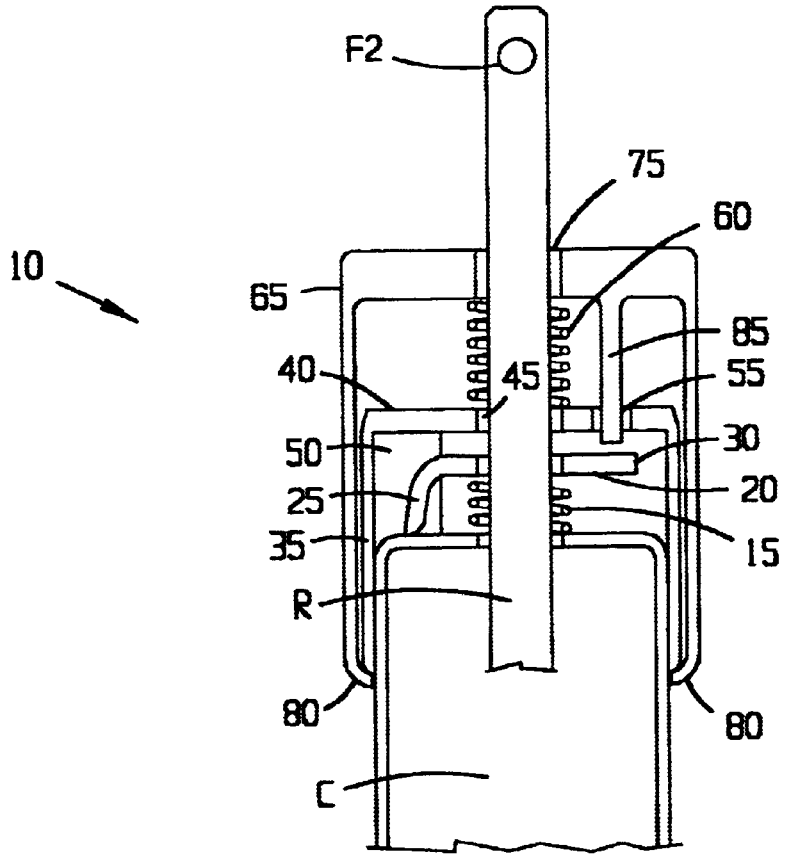
FIG. 2 is a partial cross sectional view of another embodiment of the releasable locking assembly of the present invention installed on a door control cylinder.
Figure 3A:
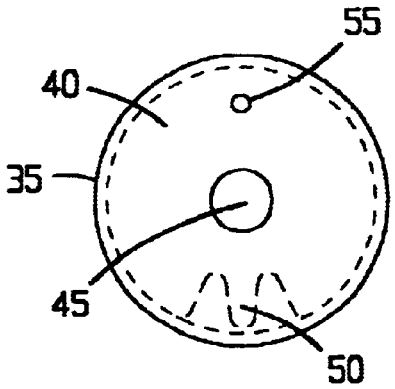
FIG. 3*a* is a top view of the first cup member of the present invention.
Figure 3B:
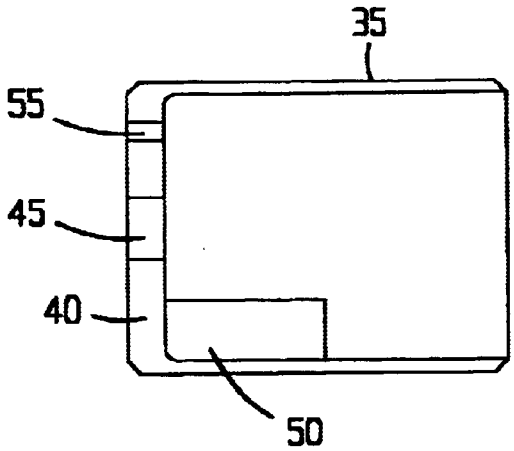
FIG. 3*b* is a cross sectional of the first cup member of the present invention.
Figure 4:
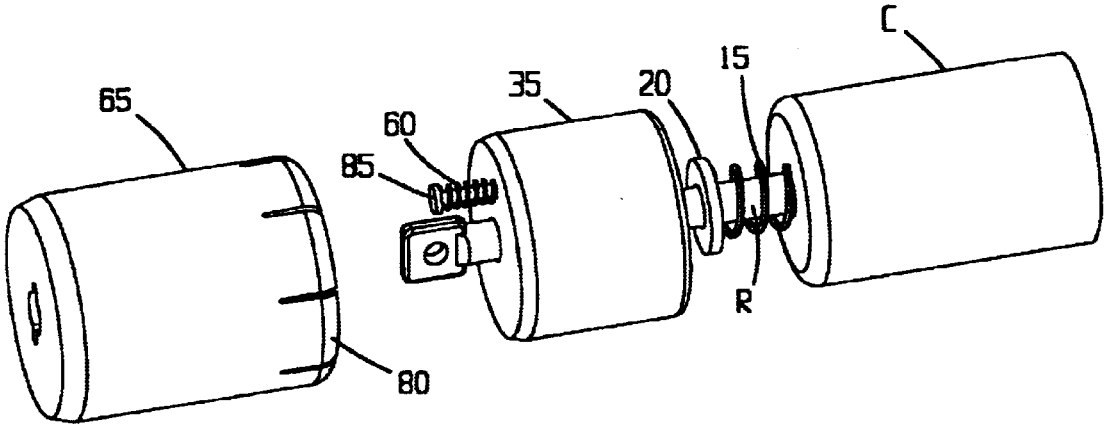
FIG. 4 is a perspective view of one embodiment of the releasable locking assembly of the present invention, which is partially installed on a door control cylinder.
Figure 5:
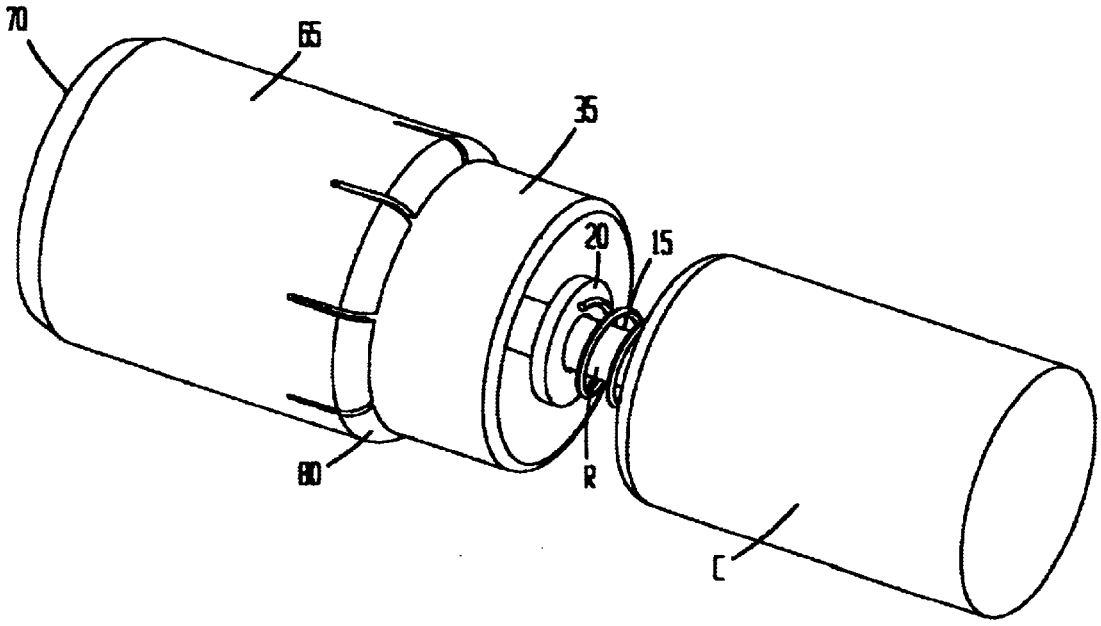
FIG. 5 is a perspective view of one embodiment of the releasable locking assembly of the present invention, which is partially installed on a door control cylinder.
Figure 6:
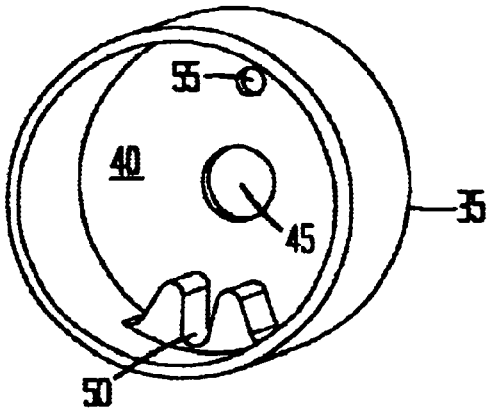
FIG. 6 is an open end view of the first cup member of one embodiment of the present invention.
Figure 7:
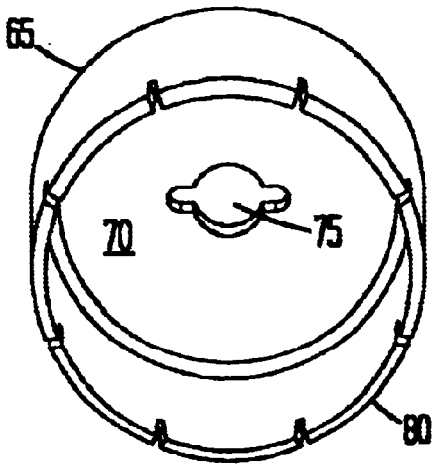
FIG. 7 is an open end view of the second cup member of one embodiment of the present invention.
Figure 8:
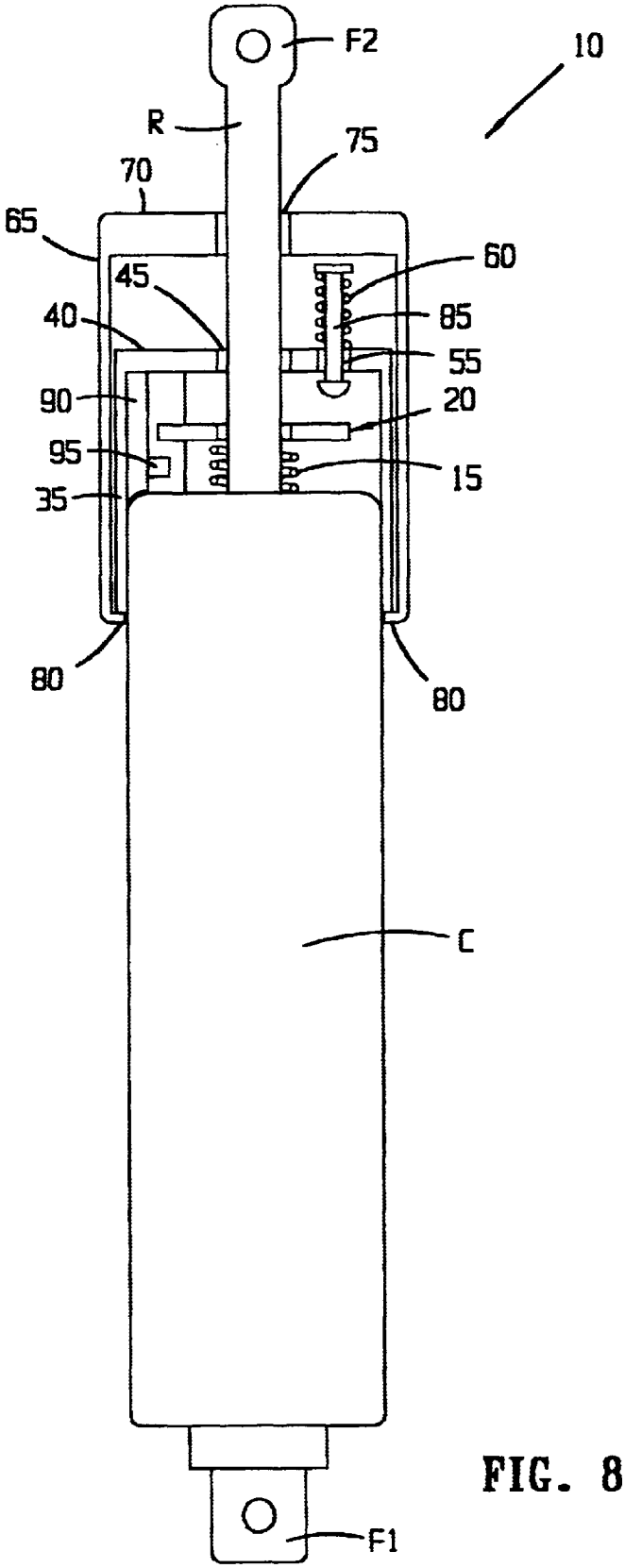
FIG. 8 is a partial cross sectional view of yet another embodiment of the releasable locking assembly of the present invention installed on a door control cylinder.

A first cylindrical cup member 35 has an axial central aperture 45 in the closed end 40 that accepts the rod R, with the open end of the cup member 35 fitting snugly over the end of the control cylinder C, as illustrated in FIGS. 1, 2 and 8. Inside the first cup member 35 is a positioning tab slot 50 into which fits the positioning tab 25 of the locking flange member 20. The tab slot 50 extends from the first cup member closed end 40 only a portion of the distance to the cup open end, thereby providing space for the locking flange member 20 to pivot, even with the end of the control cylinder C tight against the tab slot 50. Opposite the positioning tab slot 50 is an offset aperture 55 in the first cup closed end 40, the function of which is described below.

A second cylindrical cup member 65 also has an axial central aperture 75 in the closed end 70 that accepts the rod R, with the open end of the cup member 65 fitting loosely over the first cylindrical cup member 35 secured to the end of the control cylinder C, as illustrated in FIGS. 1, 2 and 8. The second cup member 65 has an inwardly protruding, retaining rim portion 80 that holds the second cup member 65 over the first cup member 35, while allowing the outer cup member 65 to move axially thereon. The closed end 70 of the second cup member 65 is biased away from the first cup member 35 by a second biasing spring 60. In one embodiment of the invention, shown in FIG. 2, the second biasing spring member 60 encircles the rod R. In this embodiment, a locking tab actuating member 85 protrudes from the closed end 70 and inside of the second cup member 65. The locking tab actuating member 85 is linear and cylindrical in shape and extends through the offset aperture 55 of the first cup closed end 40, parallel the rod R, and in register with the locking tab 30, as seen in FIG. 2.

In operation, the releasable locking assembly 10 is installed on a door control cylinder, as shown in FIGS. 4–7. The door is opened and the cylinder rod R extends to the required degree. The first biasing spring member 15 maintains the locking flange member 20 within the first cup member 35, against the closed end thereof, in an orientation perpendicular to the rod R. The user then gently pushes the second cup member 65 toward the cylinder C. This action causes the actuating member 85 to move and contact the locking tab 30, pivoting the locking flange member 20 away from perpendicular and locking the rod R from retracting into the control cylinder C, thereby holding the door open.

The user unlocks the rod R from the locking flange member 20 by opening the door slightly more. This small movement of the door and attached rod R takes pressure off the locking flange member 20, allowing the biasing spring member 15 to return the locking flange member 20 to a perpendicular orientation relative to the rod R and thereby allows the rod R to retract within the control cylinder C, allowing the door to close in a controlled manner.

In an alternative embodiment of the invention, the release tab actuation member 85 is free floating in the offset aperture 55 of the first cup closed end 40. In this embodiment, shown in FIGS. 1 and 4–8, the biasing spring 60 encircles the actuation member 85 that has enlarged ends to retain the actuation member 85 in the first cup member offset aperture 55 and maintain the biasing spring 60 there around. In this embodiment of the invention, the actuation member 85 also contacts and actuates the locking flange member 20 by the user pushing on the second cap member 65, as described above.

Referring now to FIG. 8, another alternative embodiment of the releasable locking assembly 10 is shown. Those elements common with the elements of FIGS. 1 and 2 are designated with the same number. In this embodiment, the locking flange member 20 comprises a round, flat washer encircling the rod R and biased by the first biasing spring 15. The flange member 20 has a central aperture larger than the rod diameter to allow the flange member 20 to turn slightly from perpendicular and lock on the rod R. Since the locking flange member 20 has no positioning tab 25, the positioning tab slot 50 within the first cap member 35 is replaced by a spacer member 90, which provides space for the locking flange member 20 to pivot, even with the end of the control cylinder C tight against the spacer member 90. The offset aperture 55 in the first cup member end 40 contains the spring biased release actuating member 85, as described above. In addition, a peg member 95 protrudes from the inside of the first cup member end 40 opposite the offset aperture 55. The peg member 95 serves as a fulcrum for locking the flange member 20 onto the rod R by the user gently pushing the second cup member 65 toward the cylinder C, as described above. Likewise, the flange member 20 is unlocked from the rod R by opening the door slightly more, as described above. The biased actuating member 85 and the peg member 95 cooperate to maintain the locking member 20 in a movable condition, perpendicular to the rod R, until the second cup member 65 moves toward the control cylinder C to cant the locking member 20 on the rod R to lock it in place.

The descriptions above and the accompanying materials should be interpreted in the illustrative and not the limited sense. While the invention has been disclosed in connection with the preferred embodiment or embodiments thereof, it should be understood that there may be other embodiments which fall within the scope of the invention.

The invention claimed is:

1. A releasable locking assembly for selectively locking and unlocking a door control cylinder, having a spring biased rod member extending from an end thereof, the assembly comprising:

(a) a movable locking member encircling the cylinder rod member and retained within a first confining member secured to an end of the control cylinder with the rod member extending through the first confining member, the movable locking member biased against an interior end of the first confining member opposite the control cylinder;

(b) a biased, linear actuating member paralleling the rod member and traversing the first confining member end opposite the cylinder, the actuating member movable to cant the locking member upon the rod member to secure the rod member in an extended condition; and (c) a second confining member moveably secured to said first confining member and operatively connected to said biased, linear actuation member, whereby moving the second confining member toward the first confining member causes the biased actuation member to cant the locking member on the rod member to lock the rod member in an extended condition from the control cylinder, the locking member releasing the rod member upon further extending the rod member from the control cylinder.

2. The releasable locking assembly according to claim 1 wherein, the first confining member includes a first cup member having an open end and a closed end with an axial rod aperture therein, the first cup member open end fitting securely around the end of the control cylinder, the first cup member having a spacer member therein for maintaining a confined space between the first cup member closed end and the control cylinder end for the locking member.

3. The releasable locking assembly according to claim 2 wherein, the locking member is biased. against the closed end of the first cup member by a first rod-encircling spring member.

4. The releasable locking assembly according to claim 2 wherein, the locking member includes a tab portion secured to said spacer member.

5. The releasable locking assembly according to claim 2 wherein, the actuation member is free moving and retained within an offset aperture in the first cup member closed end opposite the control cylinder with a biasing spring surrounding the actuation member exterior the first cup member.

6. The releasable locking assembly according to claim 2 wherein, the actuation member is attached to said second confining member and movable within an offset aperture in the first cup member closed end opposite the control cylinder, and the second confining member is biased relative to the first cup member by a second rod-encircling spring there between.

7. The releasable locking assembly according to claim 1 wherein, the second confining member includes a second cup member having an open end and a closed end with an axial rod aperture therein, the second cup member open end movably securely about the first confining member secured to the end of the control cylinder.

8. The releasable locking assembly according to claim 1 further including a peg member extending from the interior closed end of the first confining member opposite the control cylinder.

9. The releasable locking assembly according to claim 8 wherein, the actuating member and the peg member cooperate to maintain the locking member in a movable condition until the second confining member moves toward the control cylinder.

10. A releasable locking assembly for selectively locking and unlocking a door control cylinder, having a spring biased rod member extending from an end thereof, the assembly comprising:

(a) a movable locking member encircling the cylinder rod member and retained within a first cup member having an open end and a closed end, the open end secured to an end of the control cylinder with the rod member extending axially through the first cup member, the first cup member having a spacer member for maintaining a confined space between the first cup member closed end and the control cylinder end for the movable locking member, the movable locking member biased against an interior closed end of the first cup member opposite the control cylinder;

(b) a biased, linear actuating member paralleling the rod member and traversing the first cup member end opposite the cylinder, the actuating member free moving and retained within an offset aperture in the first cup member closed end opposite the control cylinder with a biasing spring surrounding the actuation member exterior the first cup member, the actuating member movable to cant the locking member upon the rod member to secured the rod member in an extended condition; and (c) a second cup member having an open end and a closed end with an axial rod aperture therein, the second cup member open end moveably secured about said first cup member and operatively connected to said biased, linear actuation member, whereby moving the second cup member toward the first cup member causes the biased actuation member to cant the locking member on the rod member to lock the rod member in an extended condition from the control cylinder, the locking member releasing the rod member upon further extending the rod member from, the control cylinder.

11. The releasable locking assembly according to claim 10 wherein, the locking member is biased against the closed end of the first cup member by a first rod-encircling spring member.

12. The releasable locking assembly according to claim 10 further including a peg member extending from the interior closed end of the first confining member opposite the control cylinder.

13. The releasable locking assembly according to claim 12 wherein, the actuating member and the peg member cooperate to maintain the locking member in a movable condition until the second confining member moves toward the control cylinder.

14. A releasable locking assembly for selectively locking and unlocking a door control cylinder, having a spring biased rod member extending from an end thereof, the assembly comprising:

(a) a movable locking member encircling the cylinder rod member and retained within a first cup member having an open end and a closed end, the open end secured to an end of the control cylinder with the rod member extending axially through the first cup member, the first cup member having a spacer member therein for maintaining a confined space between the first cup member closed end and the control cylinder end for the movable locking member, the movable locking member biased against an interior closed end of the first cup member opposite the control cylinder by a first rod-encircling spring member;

(b) a biased, linear actuating member paralleling the rod member and traversing the first confining member end opposite the cylinder, the actuating member free moving and retained within an offset aperture in the first cup member closed end opposite the control cylinder with a biasing spring surrounding the actuation member exterior the first cup member, the actuating member movable to cant the locking member upon the rod member to secured the rod member in an extended condition; and (c) a second cup member having an open end and a closed end with a axial aperture therein, the second cup member open end moveably secured about said first cup member and operatively connected to said biased, linear actuation member, whereby moving the second cup member toward the first cup member causes the biased actuation member to cant the locking member on the rod member to lock the rod member in an extended condition from the control cylinder, the locking member releasing the rod member upon further extending the rod member from the control cylinder.

15. A door control cylinder and locking assembly comprising;

(a) a control cylinder for attachment between a door and a door frame, including a cylindrical member having a spring biased rod member extending from an end thereof;

(b) a releasable locking assembly for selectively locking and unlocking the rod member extending from the cylinder member, the locking assembly including:

(i) a movable locking member encircling the cylinder rod member and retained within a first cup member having an open end and a closed end, the open end secured to an end of the control cylinder with the rod member extending axially through the first cup member, the first cup member having a spacer member for maintaining a confined space between the first cup member closed end and the control cylinder end for the movable locking member, the movable locking member biased against an interior closed end of the first cup member opposite the control cylinder;

(ii) a biased, linear actuating member paralleling the rod member and traversing the first cup member end opposite the cylinder, the actuating member free moving and retained within an offset aperture in the first cup member closed end opposite the control cylinder with a biasing spring surrounding the actuation member exterior the first cup member, the actuating member movable to cant the locking member upon the rod member to secured the rod member in an extended condition; and (iii) a second cup member having an open end and a closed end with an axial rod aperture therein, the second cup member open end moveably secured about said first cup member and operatively connected to said biased, linear actuation member, whereby moving the second cup member toward the first cup member causes the biased actuation member to cant the locking member on the rod member to lock the rod member in an extended condition from the control cylinder, the locking member releasing the rod member upon further extending the rod member from the control cylinder.

16. The door control cylinder and locking assembly according to claim 15 wherein, the locking member is biased against the closed end of the first cup member by a first rod-encircling spring member.

17. The door control cylinder and locking assembly according to claim 15 wherein, the actuation member is free moving and retained within an offset aperture in the first cup member closed end opposite the control cylinder with a biasing spring surrounding the actuation member exterior the first cup member.

18. The door control cylinder and locking assembly according to claim 15 wherein, the actuation member is attached to said second confining member and movable within an offset aperture in the first cup member closed end opposite the control cylinder, and the second cup member is biased relative to the first cup member by a second rod-encircling spring member there between.

19. The door control cylinder and locking assembly according to claim 15 further including a peg member extending from the interior closed end of the first cup member opposite the control cylinder.

20. The door control cylinder and locking assembly according to claim 19 wherein, the actuating member and the peg member cooperate to maintain the locking member in a movable condition until the second cup member moves toward the control cylinder.

* * * * *